United States Patent [19]

Patterson

[11] 4,405,056

[45] Sep. 20, 1983

[54] CONTAINER CLOSURE SYSTEM WITH VENT OPENING THROUGH THE CLOSURE TAPE

[75] Inventor: Richard A. Patterson, Woodbury, Minn.

[73] Assignee: Minnesota Mining & Manufacturing Company, St. Paul, Minn.

[21] Appl. No.: 378,985

[22] Filed: May 17, 1982

[51] Int. Cl.[3] ..... B65D 41/02

[52] U.S. Cl. ..... 220/271; 220/260; 220/258

[58] Field of Search ..... 220/260, 258, 271, 269, 220/270

[56] References Cited

U.S. PATENT DOCUMENTS

| | | | |
|---|---|---|---|
| 3,516,852 | 6/1967 | Janssen et al. . | |
| 3,990,603 | 11/1976 | Brochman | 220/260 |
| 4,108,330 | 8/1978 | Patterson | 220/260 |
| 4,135,637 | 1/1979 | Hannula | 220/271 |
| 4,163,506 | 8/1979 | Patterson | 220/271 |
| 4,165,015 | 8/1979 | Hasegawa | 220/269 |

*Primary Examiner*—George T. Hall

*Attorney, Agent, or Firm*—Donald M. Sell; James A. Smith; John C. Barnes

[57] ABSTRACT

An easy-openable tape closure for a container for gas-containing beverages and comprising an interior tape spanning a pour opening, an exterior tape sealed to the interior tape in the area of the pour opening and having a vent opening in the area of the pour opening. A pull tab is positioned over the exterior tape and sealed therethrough to the interior tape to provide means for rupturing the interior tape at the vent opening to vent the container.

10 Claims, 8 Drawing Figures

CONTAINER CLOSURE SYSTEM WITH VENT OPENING THROUGH THE CLOSURE TAPE

DESCRIPTION

1. Technical Field

This invention relates to containers having a preformed hole or pour opening therein covered by a removable tape closure system. More particularly, the present invention relates to an improved tape closure with a vent opening through the tape for pressure relief from the container prior to peeling back the tape over the pour opening.

2. Background Art

When packaging gas-containing beverages it is desirable that a pressure relief opening (venting means) be provided for the closure system such that when the can is to be opened the pressure is relieved from the can without the occurrence of too much noise or the loss of too much fluid because of the rapid rupture of the seal and creation of a large opening into the container. U.S. Pat. No. 3,990,603 (Brockman) describes a two-tape closure system, and the parameters that must be met by the exterior tape and the interior sheet material in a two-tape easy-open closure system in order to contain gas-containing beverages. The Brockman patent describes a relief opening located at the leading edge of and contiguous with the pour hole such that the pressure is first relieved from the can during the peeling of the opening such that the can is vented before the pour hole is opened. It was found however that opening a pressurized container having such a venting means while it is tilted, tends to spray the contents of the container from the vent opening. Other venting structures for tape closures were made, as illustrated in U.S. Pat. No. 4,135,637 (Hannula) which describes a separate opening through the container end adjacent the center thereof which is closed by the exterior tape and the interior sheet material. Peeling the exterior tape opened the center vent and the pour opening adjacent the edge of the can was not opened until the center vent had been opened. Another venting structure is shown in U.S. Pat. No. 4,165,015 (Hasegawa) which employs a tape closure for a container wherein the pull tape overlies the end panel where the pour opening is formed by a cut line and a pair of score lines extending from opposite ends of the cut line toward the center of the end panel. The vent opening is formed through the end panel between the score lines to be opened by the peeling of the pull tape. Unlike the Brochman vent opening the formation of the vent opening by Hannula or Hasegawa require an additional cutting operation on the container end. The present invention provides an improved venting system for a tape closure, and removes the need for a separate opening to be formed in the container end which further weakens the container end, results in additional metal edges being formed which may be detrimental to the closing tapes for containers filled with gas-containing beverages, and provides a vent opening located nearer the center of the container end.

DISCLOSURE OF INVENTION

The present invention provides an improvement in the hand-openable easy-opening tape closure system for a container end suitable for use with gas-containing beverages. The improvement comprises, in a two-tape closure system, a vent hole formed in the exterior tape which is sealed by the pull or grip tab being bonded to the interior tape through the vent hole. The container end assembly formed in accordance with the present invention provides a container end having an interior surface, an exterior surface and a pour opening therein with a closure including an interior tape sealed to the interior surface of the container about the pour opening, an exterior tape covering the pour opening and being adhered to the interior tape through the pour opening. The exterior tape over the opening is formed with an opening which forms a vent opening for initially relieving the pressure in the container during the opening of the closure structure. A pull tab is formed at one end of the exterior tape and covers a portion of the exterior tape and said vent opening and is secured firmly to the exposed adhesive of the interior tape at said vent opening to rupture the interior tape at the vent opening. Sealing the pull tab at the vent opening will hold the short pull tab in place over the exterior tape.

BRIEF DESCRIPTION OF DRAWINGS

The present invention will be described in more detail hereinafter with reference to the accompanying drawing wherein.

BEST MODE FOR CARRYING OUT THE INVENTION

Figure 1:
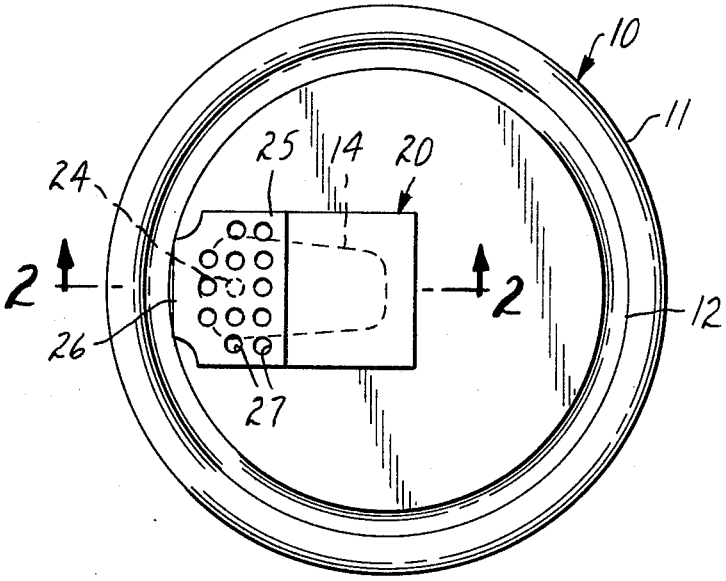
FIG. 1 is a plan view of a preferred container end assembly constructed according to the present invention.
Figure 2:
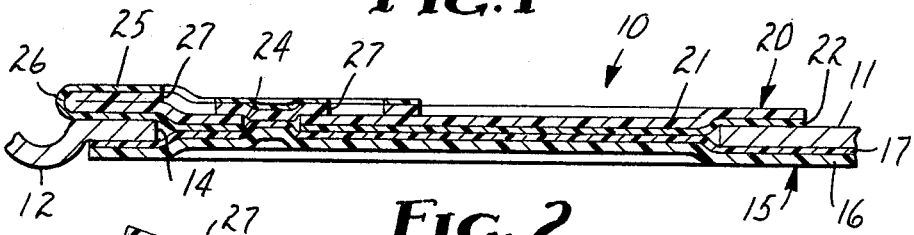
FIG. 2 is an enlarged sectional view taken along the line 2—2 of FIG. 1.
Figure 3:
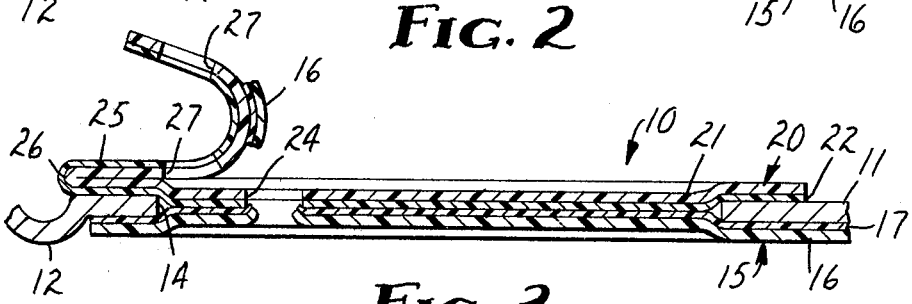
FIG. 3 is an enlarged sectional view similar to FIG. 2 showing the closure system just after the vent means has been opened.
Figure 4:
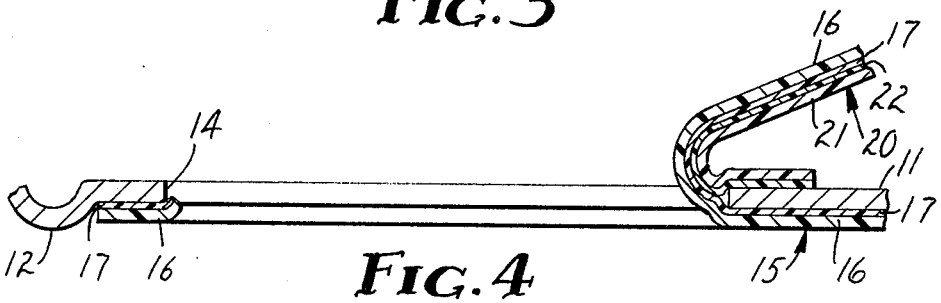
FIG. 4 is a sectional view similar to FIG. 3 after both the venting and opening of the container pour opening has occurred.

The container end assembly 10 of the present invention is illustrated as a can end 11 formed to be crimped and sealed to the upper end of a can body and comprises a generally circular, flat, disc of flexible metallic sheet material and is formed with a circular chime 12 and a pour opening 14. The can ends 11 may be produced in large numbers as in a stamping operation and then the closure is applied to the can ends. As illustrated in FIGS. 1 and 2 the closure comprises an interior tape material 15 which comprises a backing member 16 which is firmly adhered to the underside or interior surface of the can end 11 by means of an adhesive layer 17. The interior tape material 15 is adhered about the opening 14, and in the area of the opening 14 the interior tape material is adhesively secured to an exterior sheet material 20. The exterior material may also be a tape comprising a flexible backing member 21 to which is firmly anchored an adhesive layer 22 which removably adheres the backing member 21 to the can end 11 circumjacent the opening 14. The backing member 21 is formed with a die cut hole 24 in the area of the pour opening to form a vent opening and with a pull tab formed at one end of the exterior tape by the folding of the tape back upon itself as at fold line 26 to cover the exterior tape or at least the portion just past the vent opening 24. The pull tab 25 is illustrated as formed with an irregularity in the form of a plurality of openings 27 in a pattern which permit the user to grip the tab 25. The pull tab is firmly held in place over the exterior tape by sealing the same through the vent opening 24 to the exposed adhesive 17 of the interior tape 15. The vent opening 24 is positioned in the surface of the exterior tape to be within the area defined by the pour opening 14 and to be covered by a non-perforate area of the pull tab.

The closure system illustrated in FIGS. 1 and 2 is opened by gripping the tab 25 and fitting it from the exterior tape 20 and pulling it back across the vent opening 24, resulting in the tearing of the interior tape 15 by rupturing the backing 16 adhered to the pull tab 25 through the vent hole 24 by the adhesive 17. As the pull tab continues to be pulled across the exterior tape the tape unfolds along the fold line 26, and the exterior tape 20 is peeled from the exterior surface of the can end 11, peeling the exterior tape from the can. As the exterior tape continues to be pulled toward the center of the can, the interior sheet material in the area of the opening 14 remains adhered to the exterior tape 20 and tears cleanly out of the opening 14 to provide access to the contents of the container.

The exterior tape 20 plus the portion of the interior tape 15, which is adhered thereto, may be cleanly removed from the container end. Alternatively, the terminal end of the exterior tape 20, the end most closely adjacent the center of the container end, may be very firmly adhered to the container end by an adhesive strong enough to discourage or prevent complete separation of the exterior tape 20 from the container. Suitable tape constructions and adhesives are disclosed in U.S. Pat. No. 3,990,603, which is incorporated herein by reference.

Figure 5:
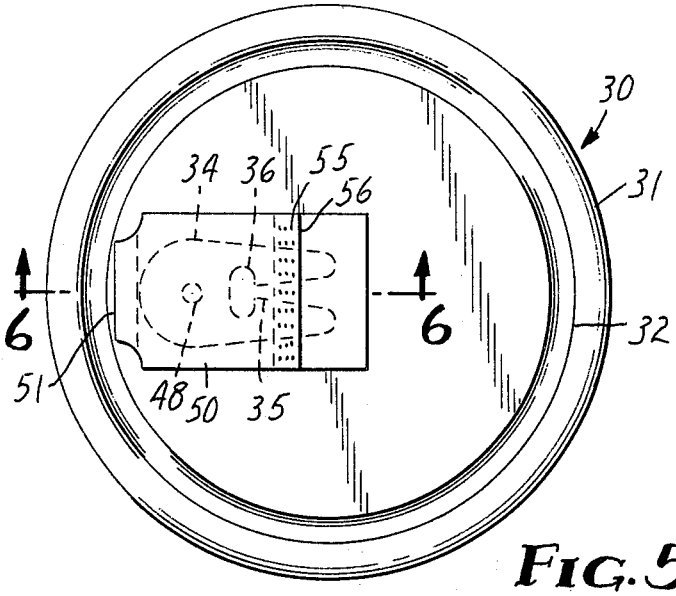
FIG. 5 is a plan view of a second preferred container end assembly constructed according to the present invention with the nondetachable closure.
Figure 6:
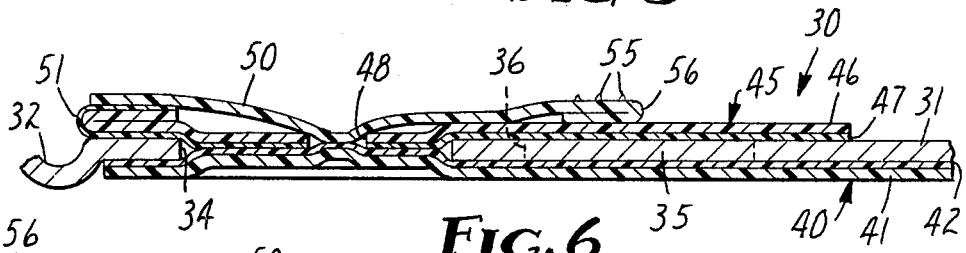
FIG. 6 is an enlarged sectional view taken along the line 6—6 of FIG. 5 showing a cross-section of the container end assembly.
Figure 7:
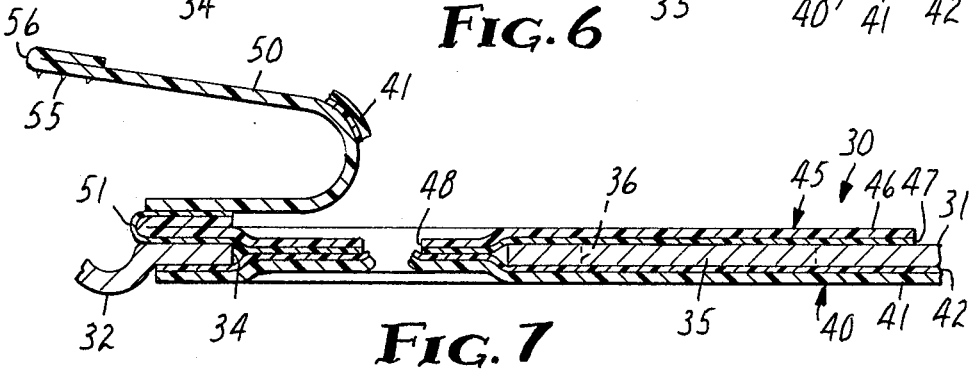
FIG. 7 is a sectional view similar to FIG. 6 showing the closure system just after the venting operation.

A second embodiment of the present invention is illustrated in FIGS. 5 through 7 wherein the container end assembly 30 has a can end 31 formed with a chime 32 and a generally U-shaped pour opening 34 which has three sides forming the outline of the pour opening, and has a tongue-like portion 35 projecting between the sides of the opening towards the base of the U-shaped opening which tongue-like portion terminates in an enlarged distal end 36. The can end 31 is formed of flexible sheet material or metal which takes a permanent set when substantially folded (e.g. 0.013 inch thick, single reduced tin free steel, tin plate, aluminum or alloys). The easy-open closure for the container end comprises a three-part, easy-open closure system having an interior tape 40 comprising a backing material 41 and an adhesive layer 42 which securely adheres the interior tape to the interior surface of can end around the opening 34 and to the tongue-like portion 35.

The exterior tape 45 comprises a flexible backing 46 to which is firmly anchored an adhesive layer 47 which removably adheres the backing member 46 to the can end 31 circumjacent the pour opening 34 and aids in the bond between the two tapes at the pour opening. The exterior tape 47 is formed with a vent opening 48 in the area of the pour opening 34 which exposes the adhesive 42 of the interior tape 40. The exterior tape is formed at one end with a pull tab 50. In this embodiment the backing 45 is folded about a fold line 51, and the adhesive 47 firmly bonds a length of grip tab sheet material 50 to the backing 46. The grip tab 50 then extends over a portion of the backing 45 and is held in position against the backing 45 by having a portion thereof firmly bonded to the interior tape 40 through the vent opening 48. The exterior tape backing 46 is secured by the adhesive 47 to the exterior surface of the can end 31 around the pour opening 34 and to the tongue-like portion 35, including the distal end 36, to sandwich the tongue-like portion between the two tapes. The bonding of the grip tab 50 through the vent opening holds the grip tab flat against the exterior surface of the exterior tape. The grip tab is formed on one end with irregularities in the surface, such as embossments 55, which permit the consumer to firmly grasp the grip tab to open the closure structure. The free end of the grip tab as illustrated is folded upon itself to provide a finished end 56.

Figure 8:
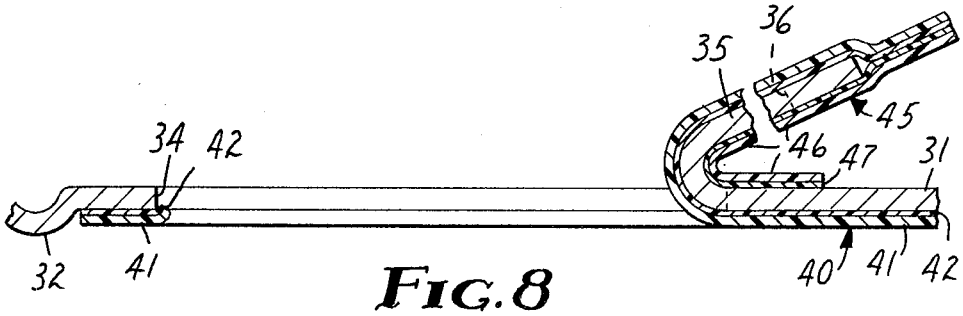
FIG. 8 is a sectional view shown with the closure entirely opened, and the tongue peeled back to retain the peeled tape closely adjacent the container end.

During the opening operation, as indicated in FIGS. 7 and 8, the grip tab 50 is lifted from the backing 46 and is pulled such that the venting of the pressure within the container, if filled with a gas-containing beverage, is provided by the grip tab 50 tearing the backing 41 in the area of the vent opening 48 forming a small opening into the container to permit the release of this pressure.

Continued lifting of the pull tab will then begin to unfold the backing 46 at the fold line 51, and to progressively peel the backing 46 and adhesive 47 from the exterior surface of the can. The interior sheet material in the area of the opening 34 remains adhered to the exterior tape 47 and tears cleanly along the edges of the opening 34 to provide access to the contents of the container. When the portions of the tape being peeled from the can end flank the distal part 36 of the tongue 35, the tongue-like portion sandwiched between the tapes is lifted from the opening. The sandwiching of the tongue-like portion 35 between the tapes provides means for securing the tape to the can end to discourage or prevent complete removal of the exterior tape 45 and pull tab 50 from the container by the consumer once the opening 34 is opened. The tape will remain attached to the tongue-like portion and the enlarged end will be lifted while the neck of the tongue bends with the tape being peeled away from the opening. The entire tongue then projects away from the opening 34 in the position shown in FIG. 8, holding the tape closely adjacent the exterior surface of the can. Since the tongue will take a permanent set, it will hold the tape clear of the opening such that it will not be objectionable to pour or drink the contents through the pour opening. The use of this tongue-like member is disclosed in U.S. Pat. No. 4,108,330, assigned to the assignee of this application.

Constructions for the interior and exterior tape backings or sheet materials and the adhesive useable therewith are disclosed in copending application, Ser. No. 264,657 filed, May 18, 1981, in the name of W. R. Brochman and assigned to the assignee of this application, now U.S. Pat. No. 4,378,074, the disclosure of which is specifically incorporated herein by reference.

Having thus described the present invention with respect to several preferred embodiments it will be understood that changes may be made without departing from the scope or spirit of this invention as stated in the appended claims.

I claim:

1. A container end assembly comprising:

a container end with an interior surface, exterior surface and a pour opening therein, and an easy-opening closure system covering said pour opening comprising:

an interior tape having an adhesive on one surface adhered to the interior surface of the container end and covering said pour opening, an exterior tape covering the pour opening and adhered therein to said interior tape, said exterior tape having a vent opening formed therein in the area of the pour opening and exposing the adhesive surface of the interior tape, said exterior tape being formed at one end beyond said opening with a pull tab covering a portion of said exterior tape and said vent opening, and said pull tab being secured firmly to the exposed adhesive of the interior tape at said vent opening in the exterior tape.

2. A container end assembly according to claim 1 including means for fastening securely said exterior tape to the exterior surface of said container and adjacent the center of the container end.

3. A container end assembly according to claim 1 wherein an adhesive is disposed to removably adhere said exterior tape to the container end around said pour opening and to permanently bond the exterior tape to said interior tape in the area of said pour opening.

4. A container end assembly according to claim 1 wherein said pull tab comprises a length of said exterior tape projecting back over said exterior tape from a fold formed in the exterior tape beyond the pour opening of the container end.

5. A container end assembly according to claim 3 wherein said pull tab comprises a separate length of sheet material laminated to said exterior tape adjacent a fold line formed in the exterior tape beyond the pour opening of the container end.

6. A container end assembly according to claim 1 wherein said pour opening is generally U-shaped and said container end has a tongue-like portion projecting between the sides of the opening and toward the base of the U-shaped opening and having an enlarged distal end sealed between the interior tape and the exterior tape for affording bending of the tongue-like portion upon peeling the exterior tape from over the U-shaped opening by pulling the pull tab over the exterior tape.

7. A container end assembly according to claim 1 wherein said pull tab has a free end formed with surface irregularities to permit grasping and is positioned adjacent the vent opening and does not extend over the entire pour opening area.

8. A container end assembly according to claim 1 wherein the pull tab is formed with surface irregularities to permit grasping of the pull tab.

9. A container end assembly according to claim 1 wherein said pull tab is formed with a plurality of holes through the end thereof and a portion of said end within the pattern of holes and free of any hole is firmly adhered to the interior tape through said vent opening.

10. A container end assembly according to claim 3 wherein said pull tab comprises a length of said exterior projecting back over said exterior tape from a fold line formed in the exterior tape beyond the pour opening of the container end.

* * * * *

UNITED STATES PATENT AND TRADEMARK OFFICE

CERTIFICATE OF CORRECTION

PATENT NO. : 4,405,056

DATED : September 20, 1983

INVENTOR(S) : Richard A. Patterson

It is certified that error appears in the above-identified patent and that said Letters Patent is hereby corrected as shown below:

Col. 1, line 31, after "however" insert a -- , --.

Col. 1, line 50, after "opening" insert a -- , --.

Col. 1, line 52, change "quire" to -- quires --.

Col. 2, line 4, after "surface" insert a -- , --.

Col. 2, line 18, delete "short".

Col. 3, line 18, change "fitting" to -- lifting --.

Col. 3, line 66, change "47" to -- 45 --.

Col. 3, line 68, after "tape" (second occurrence) insert -- 45 --.

Col. 4, line 2, change "45" to -- 46 --.

Col. 4, line 5, change "backing" to -- exterior tape --.

Col. 4, line 6, change "45" to -- 46 --.

Col. 4, line 29, delete "progres-"; and line 30, delete "sively", and after "47", insert -- progressively --.

Col. 6, line 29, after "exterior" insert -- tape --.

Signed and Sealed this

*Twenty-seventh* Day of *December 1983*

[SEAL]

*Attest:*

GERALD J. MOSSINGHOFF

*Attesting Officer*

*Commissioner of Patents and Trademarks*